US008505455B2

(12) United States Patent
Fisch et al.

(10) Patent No.: US 8,505,455 B2
(45) Date of Patent: Aug. 13, 2013

(54) MISSILE HEAD AND METHOD FOR SEPARATING A SHROUD FROM A FUSELAGE OF A MISSILE

(75) Inventors: Peter Gerd Fisch, Ueberlingen (DE); Dirk Bross, Ueberlingen (DE); Dominik Herrmann, Herdwangen (DE); Peter Mangold, Salem (DE)

(73) Assignee: Diehl BGT Defence GmbH & Co. KG, Ueberlingen/BRD (DE)

( * ) Notice: Subject to any disclaimer, the term of this patent is extended or adjusted under 35 U.S.C. 154(b) by 191 days.

(21) Appl. No.: 13/021,879

(22) Filed: Feb. 7, 2011

(65) Prior Publication Data

US 2011/0192308 A1 Aug. 11, 2011

(30) Foreign Application Priority Data

Feb. 6, 2010 (DE) ..... 10 2010 007 064

(51) Int. Cl.
*F42B 15/10* (2006.01)

(52) U.S. Cl.
USPC ..... 102/377; 244/121

(58) Field of Classification Search
USPC ..... 102/377, 378; 244/3.25, 121, 171.7, 244/172.6
See application file for complete search history.

(56) References Cited

U.S. PATENT DOCUMENTS

| | | | | |
|---|---|---|---|---|
| 6,494,406 | B1 * | 12/2002 | Fukushima et al. | 244/173.3 |
| 7,093,799 | B1 | 8/2006 | Dulat et al. | |
| 7,661,625 | B2 * | 2/2010 | Rieger et al. | 244/121 |
| 7,673,833 | B2 * | 3/2010 | Lundgren et al. | 244/171.7 |
| 2005/0000383 | A1 * | 1/2005 | Facciano et al. | 102/377 |
| 2011/0036261 | A1 * | 2/2011 | Krisher | 102/378 |

FOREIGN PATENT DOCUMENTS

| | | | |
|---|---|---|---|
| DE | 10240040 | A1 | 3/2004 |
| EP | 0425785 | A2 | 5/1991 |

* cited by examiner

*Primary Examiner* — Gabriel Klein
(74) *Attorney, Agent, or Firm* — Laurence A. Greenberg; Werner H. Stemer; Ralph E. Locher

(57) ABSTRACT

A missile head has a shroud which forms its tip and which can be detached in its totality during flight from the fuselage of the missile. The missile head further has a rear part, which is connected to the fuselage, and a front nose, which can be disconnected from the rear part and forms the tip. A separating device separates the rear part from the fuselage and the nose from the rear part during flight. A physically small shroud can be achieved, and damage to the fuselage of the missile by separation of the shroud can be prevented, if the nose is split into at least two parts and the separating device is prepared to split the nose into these two parts during flight.

12 Claims, 2 Drawing Sheets

MISSILE HEAD AND METHOD FOR SEPARATING A SHROUD FROM A FUSELAGE OF A MISSILE

CROSS-REFERENCE TO RELATED APPLICATION

This application claims the priority, under 35 U.S.C. §119, of German patent application DE 10 2010 007 064.5, filed Feb. 6, 2010; the prior application is herewith incorporated by reference in its entirety.

BACKGROUND OF THE INVENTION

Field of the Invention

The invention relates to a missile head having a shroud which forms its tip and can be detached in its totality during flight from the fuselage, and which has a rear part, which is connected to the fuselage, and a front nose, which can be disconnected from the rear part and forms the tip, and having a separating device for the separation of the rear part from the fuselage and the nose from the rear part during flight.

Guided missiles have a seeker head in their front area, with a target tracking system, by means of which they can track a target with the aid of optical means. Internal parts of the seeker head are generally protected by a window which is curved outwardly, the dome, through which radiation from a target can pass to the optics of the seeker head. During launch and during the flight of the missile, the dome is subject to mechanical and thermal loads. In order to protect the dome against external influences, such as particle bombardment or heat, the dome is covered by a shroud, which forms the tip of the guided missile, before, during and possibly still in an early flight phase after launching, in which the target tracking system is not active.

A shroud such as this generally impedes the view of the sensitive target tracking system, and can therefore be used only in a specific flight phase, in which the guided missile is not being guided to the target by the target tracking system. Before the missile is intended to be guided to the target by the target tracking system, the shroud must be jettisoned, in order to allow unimpeded target acquisition.

A shroud such as this which can be jettisoned is described, for example, in U.S. Pat. No. 7,093,799 B1 and its counterpart German published patent application DE 102 40 040 A1. The shroud is separated into a rear part and a nose arranged in front of it, which is jettisoned first. This results in an opening facing forwards being formed in the rear part, into which opening the wind of flight is forced, thus producing a high ram pressure in the rear part. The rear part is divided longitudinally into two parts, which are forced apart from one another by the ram pressure, and are thus detached from the fuselage. In consequence, the dome is free, and the seeker system can guide the missile to its target.

SUMMARY OF THE INVENTION

It is accordingly an object of the invention to provide a missile head and a method for separating a shroud from the fuselage of the missile which overcome a variety of disadvantages of the heretofore-known devices and methods of this general type and which provide for a missile head with a shroud which forms its tip, in which the shroud can be separated from the fuselage by simple means and reliably.

With the foregoing and other objects in view there is provided, in accordance with the invention, a missile head of a missile, comprising:

a shroud forming a tip of the missile head and being detachable in an entirety thereof from a fuselage of the missile during flight;

a rear part connected to the fuselage of the missile;

a forward nose mounted for disconnection from the rear part and forming the tip, the nose being formed of at least two parts; and a separating device for separating the rear part from the fuselage and the nose from the rear part during flight, and the separating device being configured to split the nose into the at least two parts during flight.

In other words, the objects are achieved by a missile head of the type described initially, in which the nose is, according to the invention, split into at least two parts and the separating device is prepared to split the nose into these two parts during flight.

In this case, the invention is based on the idea that a large amount of mechanical force is required to separate the front nose forwards, that is to say in the direction of flight, in order to reliably disconnect the nose from the rear part of the shroud. This means that the separating device must be designed to be powerful and therefore large, as a result of which the shroud is also large. The invention allows the force for separation of the nose to remain relatively small as a result of which the separating device can be made smaller, and the shroud can thus be made physically small.

The missile head may have attachment means for attaching the shroud to a fuselage part of the missile and the shroud per se, which attachment means expediently covers a dome, in particular completely covers it, which is arranged under the shroud and, after the shroud has been jettisoned, forms the furthest forward part of the missile. The missile head may have a target tracking system for steering the missile to a target. The shroud expediently forms the outer surface of the missile head, at least in its front area. It comprises at least the front nose and the rear part, in which case both the rear part as well as the nose can be subdivided into further parts, which each form an outer surface of the missile. In this case, the nose is arranged at least predominantly, and expediently completely, in front of the rear part in the direction of flight, possibly except for the attachment means and an overlap area. The fuselage of the missile may be formed by all the other elements of the missile.

The capability to separate the nose from the rear part and/or the rear part from the fuselage of the missile can be provided by an attachment means which is provided for attaching the parts to one another and for separating the parts from one another by a predetermined process. This predetermined process may comprise a predetermined introduction of force into at least two parts of the shroud and separation of the parts from one another at least one predetermined point in the attachment means, for example at a weak point.

The separating device may have a means for introducing a predetermined force into, for example, two parts of the shroud, in order to separate them from one another. The separation of the nose from the rear part and/or the rear part from the fuselage can take place immediately after the introduction of the force or indirectly as a result of a consequential process, for example the occurrence of ram pressure. The separating device is expediently designed such that the nose is first of all separated from the rear part, and the rear part is then separated from the fuselage of the missile. The two parts of the nose can be separated by the separating device by the separating device introducing a force into each of these two parts, for example by means of a pyrotechnic charge, by means of which the two parts are forced apart from one another. This makes it possible to completely or partially separate these two parts from the rear part.

When the nose has been separated, the shroud expediently has an opening facing forwards. This allows a ram pressure to be formed in the rear part, which causes the rear part to be separated from the fuselage, or at least makes this easier. The separating device is expediently designed to separate the nose from the rear part, thus forming an opening in the rear part during flight, resulting in ram pressure in the rear part.

The invention can be used particularly advantageously for a missile with wings which result in the missile having a span which is at least twice as great as the caliber of the missile. The assistance of the ram pressure during separation of shroud parts from the fuselage allows them to be forced sufficiently far away from the fuselage, even at a high speed of flight, such that they do not touch the wings of the missile as it flies onwards, and do not damage them. When the speed of flight is low, the separating device expediently provides sufficient separating energy in order to move both the two parts of the nose and the rear part sufficiently far away from the center axis of the missile.

In one advantageous embodiment of the invention, the two parts of the nose can be moved away from one another laterally with respect to the direction of flight, expediently in opposite directions. This allows the two parts to be moved sufficiently far away from the missile with relatively little force being applied, without damaging the missile as it flies onwards. The two parts of the nose are expediently formed by a longitudinal split in the nose, thus making it easier to move these parts away from one another laterally with respect to the direction of flight. In this case, the longitudinal direction is parallel to the direction of flight of the missile.

The two parts of the nose may be directly adjacent to one another, via a separating joint, the two ends of which open in a separating joint between the nose and the rear part. In particular, these openings are precisely opposite one another. It is furthermore advantageous for the nose and the rear part both to be split longitudinally via separating joints, with the separating joint for the nose and the separating joint for the rear part opening offset with respect to one another in a separating joint between the nose and the rear part. This allows the nose to hold the rear part together, easily and robustly.

In accordance with an additional feature of the invention, the outer surfaces of the two parts of the nose are asymmetric with respect to one another. After the nose has been separated into these two parts, these parts can be moved in the airflow such that it is improbable that they will fly back in the direction of the missile, and therefore that one of these parts will damage the missile. The asymmetry may be with respect to a center axis of the missile. By way of example, the outer surface of one part may be larger than the outer surface of the other part. An asymmetric separating joint between the two front parts is likewise feasible.

An advantageous unstable flight behavior of the two front parts can be achieved if the tip of the nose up to at least 5 mm behind the foremost point is formed by only one of the two parts of the nose.

A further advantageous embodiment of the invention provides that the missile head has a connecting means, in particular a flexible connecting means, via which one of the two parts of the nose remains connected to the rear part while it is still moving away from the rear part, after separation from the rear part. The separating energy which is introduced into the front part as it is removed, by the separating means or in some other manner, can be introduced into the rear part via the connecting means such that said means is separated from the fuselage by the separating energy, or the separating energy at least assists a separation process. The flexibility of the connecting means can be achieved by it having a capability to bend through at least 180°, with the connecting means expediently being a cable, in particular a steel cable.

Furthermore, it is advantageous if the missile head has a connecting means via which one of the two parts of the nose tears at least a part of the rear part outwards after being disconnected from the rear part. This makes it possible to separate the rear part from the fuselage, or at least can make this easier. The ram pressure and the connecting means advantageously act jointly on separation of the rear part from the fuselage, for example by jointly pulling the rear part away from the fuselage to the side. Advantageously, the connecting means pulls a front area of the rear part further away from the center axis of the missile than a rear area. The outward direction is in this case a direction away from a center axis of the missile, in particular at right angles away from the center axis.

In order to allow separating energy to be transmitted to as great an extent as possible from the nose to the rear part, it is advantageous for the connecting means not to have to transmit the energy at one time, but for a time period to be available for this purpose. The connecting means is expediently designed to be elastic for this purpose. The elasticity can be achieved if, in its taut state, the connecting means is designed to lengthen by at least 3 mm, in particular 5 mm, before tearing.

It is furthermore advantageous for the connecting means to have a lengthening means for material lengthening of the connecting means by at least 3 mm beyond a taut connection. This can once again result in a time period for transmission of separating energy being achieved. A material extension may in this case be understood to mean that material is added to lengthen the connecting means between its two attachment points, for example by providing more cable. The material extension can be achieved by a cable loop with a braking means, which, for example, is tautened when moving away from the front part to the rear part, and during tautening of the connecting means.

With the above and other objects in view there is also provided, in accordance with the invention, a method of separating a shroud from a fuselage of a missile during flight of the missile, the method which comprises:

providing the shroud with a front nose formed of two parts and with a rear part;

during the flight of the missile, forcing the two parts apart from one another with a separating device and thereby detaching the front nose of the shroud from the rear part, and subsequently detaching the rear part from the fuselage.

In other words, the invention also relates to a method for separation of a shroud from a fuselage of a missile during flight of the missile, in which a front nose of the shroud is moved away from a rear part of the shroud. The wind of flight can result in a ram pressure being formed in the rear part as a result of the removal of the shroud, detaching the two parts of the rear part from the fuselage.

It is proposed that, according to the invention, the nose comprises two parts which are forced apart from one another by a separating device and in the process are detached from the rear part and then the rear part is detached from the fuselage. The nose can be completely separated from the rear part with relatively little force being applied.

The rear part is advantageously longitudinally split such that ram pressure can force the two parts away from one another to the side, and can thus detach them from the fuselage. The process of forcing the two parts of the nose away from one another, in particular to the side, makes it possible to achieve a chain reaction in the separation of the shroud from the fuselage of the missile. The two parts of the nose are first of all forced away from one another, after which the rear part, in particular the two parts of the rear part, are forced away from one another. This chain reaction allows the shroud to be reliably separated from the fuselage with little force being applied, and allows the shape of the rear parts, which in particular are larger than the two parts of the nose, to be kept such that they are not driven back sliding on an air cushion into the missile, and do not damage it, in particular its wings.

In accordance with a concomitant, advantageous feature of the novel method, each of the parts of the nose pulls a part of the rear part laterally away from a missile axis. This allows the rear part to be separated from the fuselage even when flying slowly, when, for example, the ram pressure is insufficient to separate the rear part from the fuselage.

Other features which are considered as characteristic for the invention are set forth in the appended claims.

Although the invention is illustrated and described herein as embodied in a missile head and method for separation of a shroud from a fuselage of a missile, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
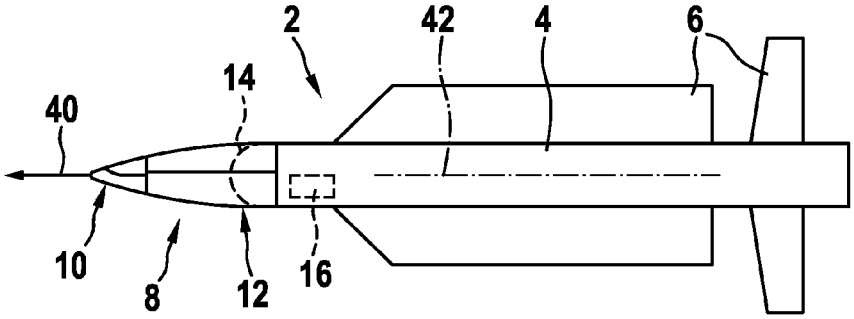
FIG. 1 shows a missile with a shroud which can be detached during flight.

Referring now to the figures of the drawing in detail and first, particularly, to FIG. 1 thereof, there is shown a schematic illustration of a missile 2 having a fuselage 4, to which wings 6 are fitted, and a shroud 8 which forms the tip of the missile 2. The shroud 8 consists of a front nose 10 and a rear part 12, and protects a dome 14, which is arranged completely under the shroud 8. Jettisoning of the shroud 8 is controlled by a control unit 16.

Figure 2:
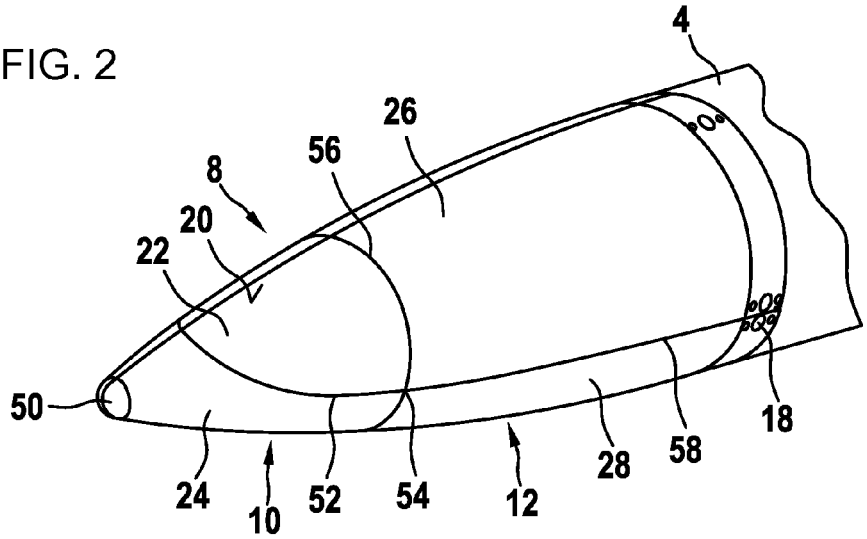
FIG. 2 shows the missile head of the missile.
Figure 5:
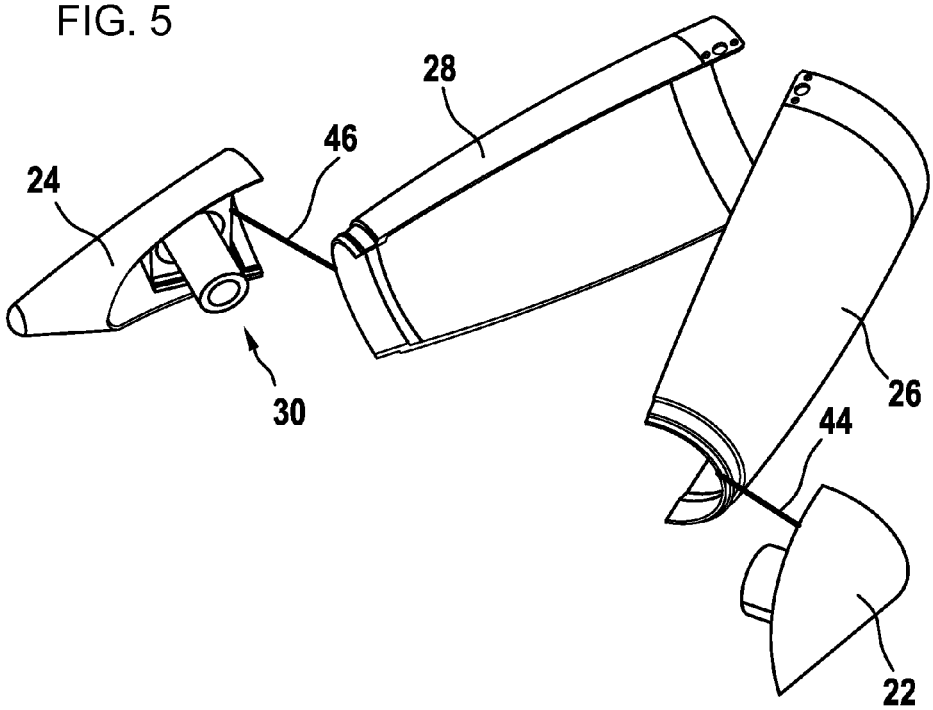
FIG. 5 shows the shroud completely separated from the fuselage of the missile.

FIG. 2 shows a perspective illustration of the head of the missile 2. The shroud 8 is attached to the fuselage 4 of the missile 2 by attachment means 18, for example screws. The shroud 8 is formed by four parts 22, 24, 26, 28, which each form an area of the outer surface 20 of the missile 2 and are illustrated separated from one another in FIG. 5. The two front parts 22, 24 of the shroud 8 form the nose 10 of the shroud 8, and the rear parts 26, 28 form the rear part 12 of the shroud 8.

Figure 3:
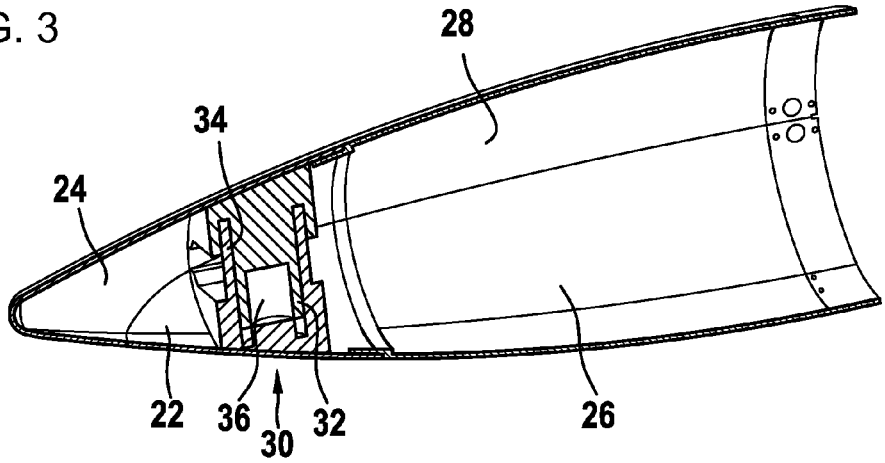
FIG. 3 shows a section through the shroud.

A separating device 30 can be seen in the section drawing shown in FIG. 3 through the shroud 8 and through the four parts 22, 24, 26, 28, by means of which separating device 30 the front parts 22, 24 of the nose 10 are forced away from one another during flight of the missile 2, and which holds the four parts 14-20 of the shroud 8 together before this. The separating device 30 has two tubes 32, 34, which are inserted into one another, and a pyrotechnic propellant charge 36, which is inserted into the inner tube 32. This propellant charge 36 is connected indirectly or directly via cables to the control unit 16 in the fuselage 4 of the missile 2, such that the pyrotechnic propellant charge 36 can be initiated with the aid of a control signal from the control unit 16.

Before flight, during the launch phase and during a first part of the flight of the missile 2, the two front parts 22, 24 of the nose 10 are held firmly together by the separating device 30, for example, by the two tubes 32, 34, which are connected to one another with a friction lock by means of a mutual interference fit. The nose 10 surrounds the front area of the rear part 12, as can be seen in FIG. 3, such that the two parts 26, 28 are likewise held firmly together by those parts 22, 24 of the nose 10 which are firmly connected to one another. In the area in which the nose 10 overlaps the rear part 12, the nose 10 and the rear part 12 are connected to one another in an interlocking manner by means of a tongue-and-groove connection, such that it is impossible for the nose 10 to be detached from the rear part 12 without separating the nose 10 into the two parts 22, 24, which are separated from one another, as illustrated in FIG. 3. The tongue-and-groove connection furthermore prevents the nose 10 from sliding forward and away from the rear part 12.

Figure 4:
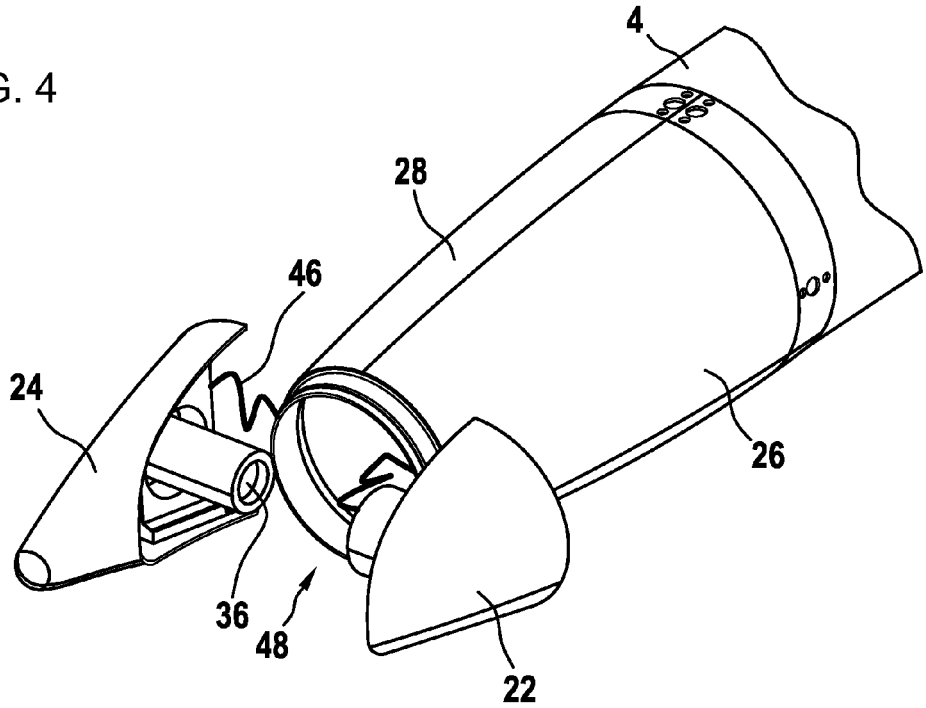
FIG. 4 shows the shroud after separation of the nose from the rear part of the shroud.

After the missile 2 has been launched and during flight in the direction of flight 40, which is parallel to a center axis 42 of the missile 2, the control unit 16 passes a signal to the separating device 30 at a predetermined time or when the missile 2 or a part of it is in a predetermined state. This initiates the pyrotechnic propellant charge 36, which blows the two front parts 22, 24 of the nose 10 away from one another, as is illustrated in FIG. 4. The two front parts 22, 24 are in this case forced away from one another in opposite directions and to the side, away from the center axis 42, and are thus also separated and moved away from the rear part 12.

The parts 22, 24 of the nose 10 are each still connected via respective connecting means 44, 46 to the respective part 26 or 28 which is located behind them when attached, such that, although the two front parts 22, 24 can move freely with respect to the rear parts 26, 28, this is, however, only as far as a defined distance between the part 22 and the part 26, and between the part 24 and the part 28. The two connecting means 44, 46 are each in the form of wire cables, whose ends are attached to one of the respective parts 22, 24 or 26, 28. When the two front parts 22, 24 have reached the distance from the rear parts 26, 28 predetermined by the respective connecting means 44 and 46, then the connecting means 44, 46 become taut, and the separating energy which is transmitted via the pyrotechnic propellant charge 36 to the two front parts 22, 24 is partially transmitted to the rear parts 26, 28, since these are torn apart from one another forwards via the connecting means 44, 46 as the parts 22, 24 move away. This state is illustrated in FIG. 4. The separating energy of the separating device 30 is in this case designed such that the two front parts 22, 24 are separated first of all, and then the two rear parts 26, 28 are separated from the fuselage 4 of the missile 2, even when it is stationary or flying slowly, for example by the attachment means 18 braking at a weak point, for example in an attachment screw.

In order to ensure that the separating energy is at least largely transmitted from the front part 22 to the rear part 26, and from the front part 24 to the rear part 28, the two connecting means 44, 46 are each designed to be somewhat elastic, such that the separating energy to be transmitted need not be transmitted at the moment when the connecting means 44, 46 become taut, but a time period is available, during which the connecting means 44, 46 each lengthen by about 5 mm before they tear. The separating energy of the separating device 30 and the strength of the connecting means 44, 46 are designed such that the connecting means 44, 46 tear after the separating energy has been transmitted to the rear parts 26, 28, such that the part 22 is completely separated from the part 26, and the part 24 is completely separated from the part 28. The effect of the elastic lengthening can be reinforced or replaced by a lengthening of the material of the connecting means 44, 46. This is achieved by means of a loop, which is not illustrated, in both wire cables, which is tightened via a braking means when the cables are taut and the parts 22, 24, 26, 28 move further away from one another.

After the nose 10 has been separated from the rear part 12, as is illustrated in FIG. 3, an opening 48 facing forwards is formed in the rear part 12. The wind of flight is forced into this opening, and causes a ram pressure in the interior of the rear part 12, which ram pressure forces the two parts 26, 28 away from one another. When flying at high speed, the ram pressure is sufficient to detach the parts 26, 28 from the fuselage 4. The separation is also assisted by the parts 22, 24 via the connecting means 44, 46. If the missile 2 is still flying slowly when the separating device 30 is operated, the separation energy of the separating device 30 is sufficient to also detach the rear parts 26, 28 from the fuselage 4.

The two parts 22, 24 of the nose 10 are asymmetric with respect to one another. The tip 50 and the complete area of the outer surface 20 of the missile 2 or of the shroud 8 up to 5 cm behind the tip 50 are formed only by the part 24. The furthest forward part of the part 22 thus extends only up to 5 cm from the tip 50. This asymmetry results in the two parts 22, 24 having a staggering flight behavior, which prevents the wind of flight moving them back towards the missile 2 again, and damaging it. Although the two parts 26, 28 are designed to be symmetrical to one another, the lack of the tip likewise results in a staggering movement in the airflow, such that they are also not moved back again towards the missile 2, damaging it.

The two parts 22, 24 of the nose 10 are connected to one another, and are separated from one another or are adjacent to one another, via a separating joint 52. This provides the longitudinal separation of the two parts 22, 24, with their two ends (only the end 54 is illustrated in FIG. 2) opening precisely opposite one another in a further separating joint 56, which separates the nose 10 from the rear part 12, and forms the tongue-and-groove connection. The two rear parts 26, 28 are separated via two separating joints (of which only one separating joint 58 is shown in FIG. 2), with each of the separating joints 58 opening into the separating joint 56 at the same point, in the same way as the separating joint 52. This is not the case in the exemplary embodiment illustrated in FIG. 1. Here, the separating joints 58 open into the separating joint 56 between the rear parts 26, 28, with an offset with respect to the separating joint 52. This results in the four parts 22, 24, 26, 28 forming a robust assembly.

The invention claimed is:

1. A missile head of a missile, comprising:

a shroud forming a tip of the missile head and being detachable in an entirety thereof from a fuselage of the missile during flight, the shroud comprising:

a rear part connected to the fuselage of the missile, and a forward nose mounted for disconnection from said rear part and forming the tip, said nose being formed of at least two parts;

a separating device for separating said rear part from the fuselage and said nose from said rear part during flight, and said separating device being configured to split said nose into said at least two parts during flight; and connecting means for retaining one of said two parts of said nose connected to said rear part while said one of said two parts is moving away from said rear part, after separation from said rear part.

2. The missile head according to claim 1, wherein said at least two parts of said nose are movable away from one another laterally with respect to a direction of flight.

3. The missile head according to claim 1, wherein said at least two parts of said nose have outer surfaces that are asymmetric with respect to one another.

4. The missile head according to claim 1, wherein said tip of said nose, up to at least 5 mm rearward of the forward-most point of said tip, is formed by only one of said at least two parts of said nose.

5. The missile head according to claim 1, wherein said connecting means, in a taut state thereof, is configured to stretch by at least 3 mm prior to tearing.

6. The missile head according to claim 1, wherein said connecting means includes a lengthening means for material lengthening of said connecting means by at least 3 mm beyond a taut connection.

7. The missile head according to claim 1, which comprises connecting means via which one of said two parts of said nose tears at least a part of said rear part outwardly after being disconnected from said rear part.

8. The missile head according to claim 7, wherein said connecting means, in a taut state thereof, is configured to stretch by at least 3 mm prior to tearing.

9. The missile head according to claim 7, wherein said connecting means includes a lengthening means for material lengthening of said connecting means by at least 3 mm beyond a taut connection.

10. A method of separating a shroud from a fuselage of a missile during flight of the missile, the method which comprises:

providing the shroud with a front nose formed of two parts and with a rear part;

during the flight of the missile, forcing the two parts apart from one another with a separating device and thereby detaching the front nose of the shroud from the rear part, and subsequently detaching the rear part from the fuselage; and retaining one of the two parts of the front nose connected to the rear part while the one of the two parts is moving away from the rear part, after separation from the rear part.

11. The method according to claim 10, which comprises causing each of the two parts of the nose to pull a portion of the rear part laterally away from a missile axis.

12. A method of separating a shroud from a fuselage of a missile during flight of the missile, the method which comprises:

providing the shroud with a front nose formed of two parts and with a rear part;

during the flight of the missile, forcing the two parts apart from one another with a separating device and thereby detaching the front nose of the shroud from the rear part, and subsequently detaching the rear part from the fuselage; and causing each of the two parts of the nose to pull a portion of the rear part laterally away from a missile axis.

* * * * *